US005161949A

United States Patent [19]

Brioude et al.

[11] Patent Number: 5,161,949

[45] Date of Patent: Nov. 10, 1992

[54] ROTOR FITTED WITH SPACER BLOCKS BETWEEN THE BLADES

[75] Inventors: Michel A. Brioude, Melun; Philippe Chereau, Savigny Le Temple; Jacky Naudet, Bondoufle, all of France

[73] Assignee: Societe Nationale d'Etude et de Construction de Moteurs d'Aviation "S.N.E.M.C.A.", Paris, France

[21] Appl. No.: 799,326

[22] Filed: Nov. 27, 1991

[30] Foreign Application Priority Data

Nov. 28, 1990 [FR] France ..... 90 14850

[51] Int. Cl.[5] ..... F01D 5/22

[52] U.S. Cl. ..... 416/193 A; 416/500

[58] Field of Search ..... 415/220 R, 219 R, 193 A, 415/248, 500, 190

[56] References Cited

U.S. PATENT DOCUMENTS

| | | | |
|---|---|---|---|
| 3,294,364 | 12/1966 | Stanley | 416/193 A |
| 4,655,687 | 4/1987 | Atkinson | 416/193 A |
| 4,872,810 | 10/1989 | Brown et al. | 416/500 |
| 5,049,035 | 9/1991 | Marlin | 416/193 A |

FOREIGN PATENT DOCUMENTS

| | | | |
|---|---|---|---|
| 1134548 | 4/1957 | France . | |
| 1579923 | 8/1969 | France . | |
| 2164196 | 7/1973 | France . | |
| 981476 | 1/1965 | United Kingdom | 416/193 A |
| 1259750 | 1/1972 | United Kingdom . | |
| 2006883 | 5/1979 | United Kingdom . | |

*Primary Examiner*—John T. Kwon

*Attorney, Agent, or Firm*—Oblon, Spivak, McClelland, Maier & Neustadt

[57] ABSTRACT

A fan or compressor stage rotor comprises a disc, radial blades mounted in axial sockets formed in the periphery of the disc, and spacer blocks interposed between the blades to constitute the inner boundary of the air flow path through the rotor. The spacer blocks each comprise an outer wall which is spaced from the periphery of the disc, and front and rear walls extending radially inwardly to overlap at least partially the front and rear faces of the disc. The front and rear walls each comprise at least one hook which co-operates with a corresponding groove provided in the respective face of the disc to fix the spacer block to the disc. The spacer block also comprises a median partition projecting inwards from its outer wall and having a slot through which passes a leaf spring of a vibration damper.

4 Claims, 3 Drawing Sheets

ROTOR FITTED WITH SPACER BLOCKS BETWEEN THE BLADES

BACKGROUND OF THE INVENTION

1. Field of the Invention

The present invention relates to a rotor for a fan or compressor stage of a turboshaft engine, of the type comprising a rotor disc, an array of radial blades mounted in axially extending sockets formed in the periphery of the disc, a series of spacer blocks disposed between the blades so as to maintain the inter-blade spacing, means for attaching the spacer blocks to the disc, and means for axially retaining the blades in their respective sockets, each of said spacer blocks having an outer wall which is spaced from the periphery of said disc and which, together with the outer walls of the other spacer blocks, defines the inner boundary of the fluid flow path from upstream to downstream through the rotor.

This type of rotor is particularly used in stages of large diameter because it is imperative, on the one hand, to limit the diameter of the disc carrying the blades on account of the considerable centrifugal force exerted at high rotational speeds of the turboshaft engine and, on the other hand, to increase the inner diameter of the path of fluid flowing from upstream to downstream through the stage so as to have a generally uniform speed of flow of the fluid throughout the whole cross section of the path.

In the case of blades of small size, it is common practice to use blades with platforms. But when the blades are of large size, this technique is undesirable because it involves a substantial increase in the weight of the blade roots.

2. Summary of the Prior Art

British Patent No. 2 006 883 in particular discloses a rotor for a stage of a turboshaft engine of the type mentioned above. The spacer block described in this patent comprises, at the rear, a hook which is directed upwards and engages with a matching groove provided in a first retaining ring attached by a bayonet fixing to the rear face of the disc and, at the front, a rib which extends towards the axis of the disc and co-operates with the front face of the disc to prevent axial movement of the spacer block towards the rear. A second retaining ring is fixed by bolts on the front face of the disc to connect the front end of the spacer block to the disc.

With this mode of construction and fixing, it is necessary for the spacer block to have an inner wall which only partially bears against the periphery of the disc in such a way as to enable the rear hook to be engaged in the corresponding groove of the first retaining ring by tilting the spacer block on the periphery of the disc. This results in a complex configuration for the spacer block and an increase in weight. In addition, the bayonet fixing arrangement serving to fasten the first retaining ring to the rear face of the disc requires a difficult machining operation on the disc and on the ring.

SUMMARY OF THE INVENTION

The aim of the present invention is to alleviate these disadvantages and to provide a rotor for a turboshaft engine of the type mentioned earlier in which the spacer blocks have a simpler configuration and in which the means for fixing the spacer blocks to the disc are different and easy to implement.

To this end, according to the invention there is provided a rotor for a fan or compressor stage of a turboshaft engine, said rotor having an axis of rotation and comprising:

a rotor disc having front and rear faces and a periphery, said periphery being formed with a plurality of sockets extending between said front and rear faces at intervals around said disc;

a plurality of blades mounted in said sockets and extending radially from said disc;

a plurality of spacer blocks disposed between said blades for maintaining the inter-blade spacing, said spacer blocks having axially opposite ends disposed substantially in the planes of said front and rear faces of said disc, and said spacer blocks each comprising an outer wall spaced outwardly from said periphery of said disc, and front and rear walls extending substantially radially inwards from said outer wall at said axially opposite ends of said spacer block so as to overlap at least partially said front and rear faces respectively of said disc, said outer wall having inner and outer faces, and said outer faces of said outer walls of said spacer blocks defining the inner boundary of the fluid flow path through said rotor;

means for fixing said spacer blocks to said disc; and means for axially retaining said blades in said sockets;

said means for fixing said spacer blocks to said disc comprising, for each of said spacer blocks, at least one front hook extending axially rearwards from said front wall of said spacer block, at least one rear hook extending axially forwards from said rear wall of said spacer block, and grooves provided in said front and rear faces of said disc for receiving said front and rear hooks respectively, said grooves extending between the two sockets in which the blades adjacent said spacer block are mounted, and said grooves and said hooks being arranged and dimensioned such that said spacer block can be fitted by inserting it in one of said two sockets and then sliding it in the plane of said disc to engage said hooks in said grooves.

The grooves and hooks operate in conjunction with one another to retain the spacer block radially when the disc is rotating, and the front and rear walls of the spacer block co-operate with the disc to retain the spacer block axially at the front and rear. The grooves preferably have an arcuate shape of which the centre of curvature is on the axis of the disc, but this is not essential. Their shape must, however, be such as to allow the fitting of the spacer block by sliding it in the plane of the disc.

The spacer blocks are thus fitted without being bolted. The bayonet fixing arrangement of the prior art referred to above is done away with, and machining of the disc is simplified.

Preferably, each spacer block possesses at least one flange which extends from said rear wall of said spacer block and overlaps at least partially one of said sockets adjacent said spacer block, and a locking lug which extends radially towards said rotor axis from said front wall of said spacer block, said locking lug being spaced from said front face of said disc, and said disc having an additional groove for receiving and co-operating with said locking lug, and wherein said means for axially retaining said blades in said sockets comprise an annular member interposed between said front face of said disc and said locking lugs of said spacer blocks on one side of the rotor, and said flanges of said spacer blocks on the other side of the rotor.

Preferably, each spacer block possesses a median partition which extends from its outer wall towards the periphery of the disc and which is substantially parallel to the planes of the blades adjacent the spacer block, said partition having a slot in the region of the outer wall, and the spacer block is fitted with a vibration damper formed by a leaf spring passing through the slot and damping pads fitted at the ends of the leaf spring.

Preferably, each spacer block includes additional walls extending from said inner face of said outer wall on opposite sides of said partition, said additional walls serving as limit stops for said damping pads.

Other features and advantages of the invention will become apparent from the following description of a preferred embodiment of the invention with reference to the accompanying drawings.

DESCRIPTION OF THE PREFERRED EMBODIMENT

Figure 1:
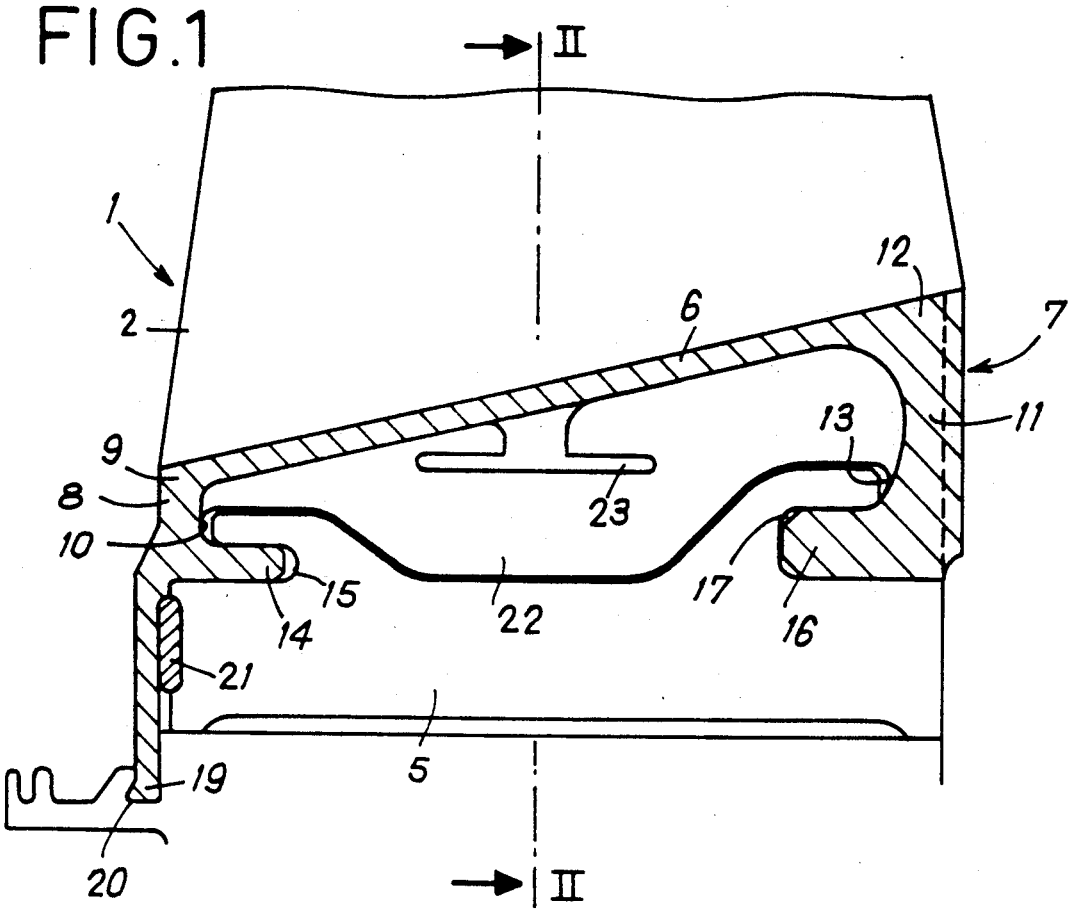
FIG. 1 is a section through part of a preferred embodiment of a rotor in accordance with the invention, the section being taken in a plane passing through the axis of rotation of the rotor and equidistant from two adjacent blades of the rotor.
Figure 2:
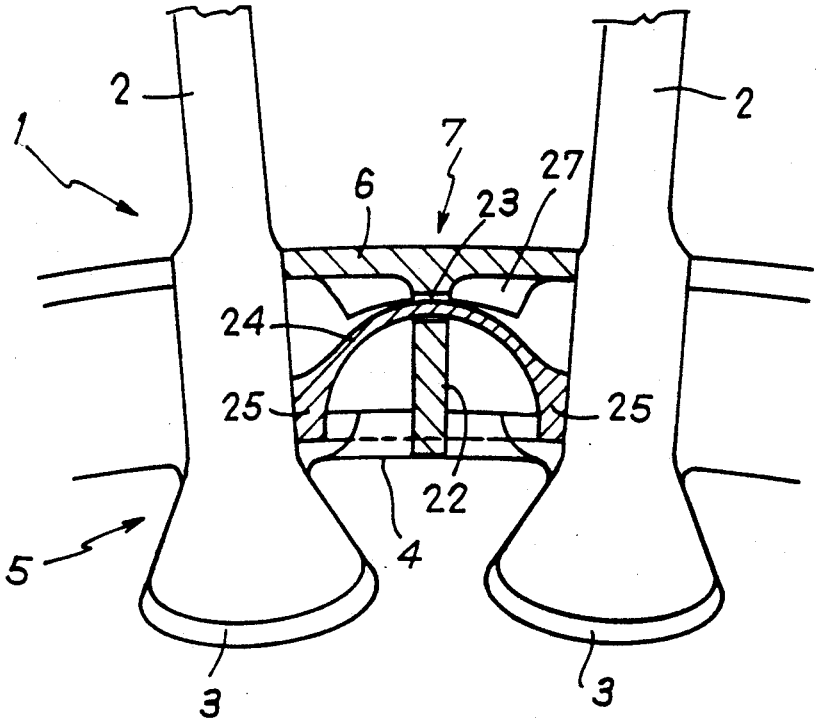
FIG. 2 is a partial section through the rotor taken in a plane perpendicular to the axis of the rotor and on the line II—II of FIG. 1.
Figure 3:
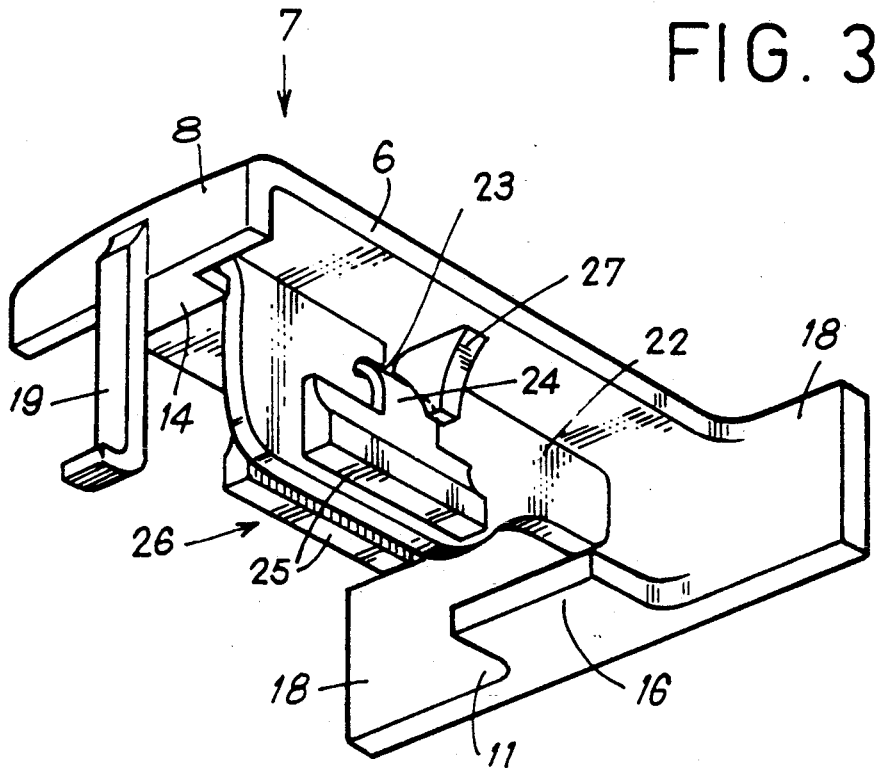
FIG. 3 is an underneath perspective view of a spacer block of the rotor, the spacer block being fitted with a vibration damping device.
Figure 4:
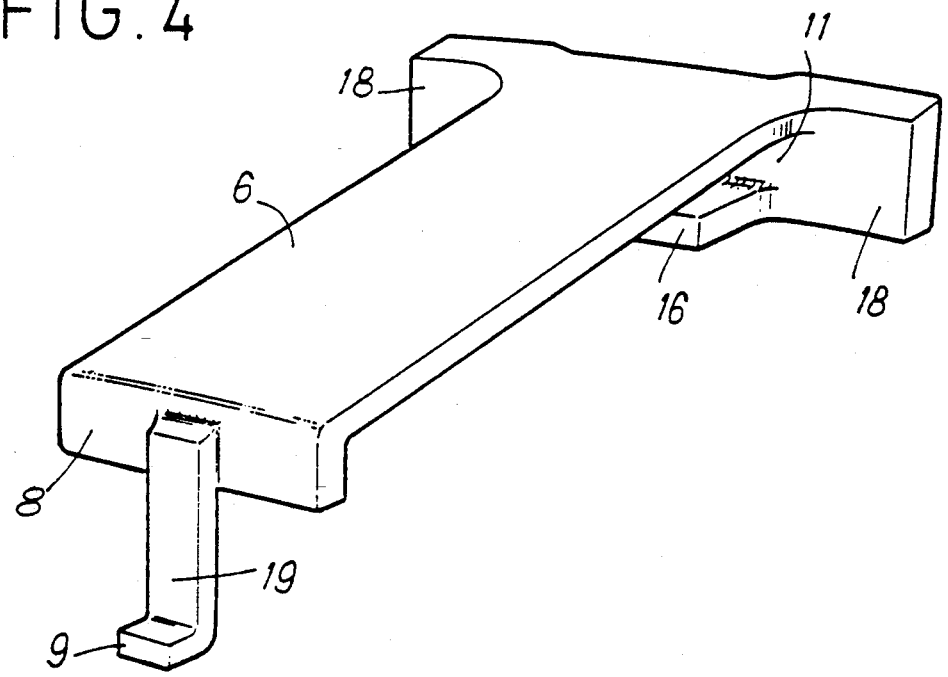
FIG. 4 is a top perspective view of the spacer block.
Figure 5:
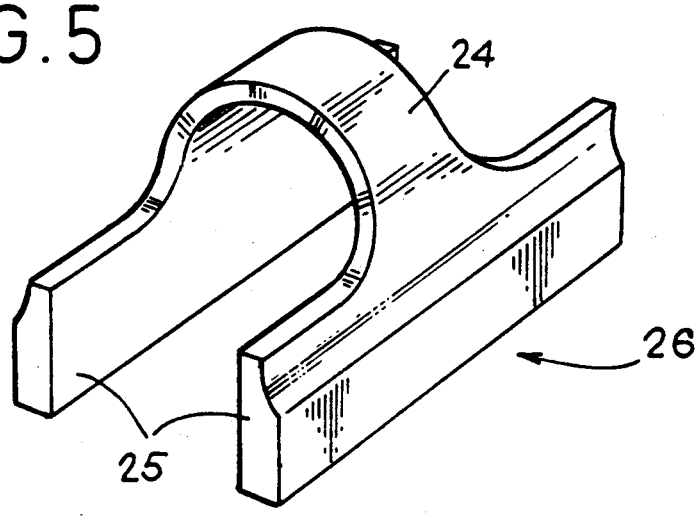
FIG. 5 is a perspective view of the vibration damping device.

The drawings illustrate a rotor 1 of a stage of a turbo-shaft engine in which the blades 2 are mounted in substantially axially extending sockets 3 provided at intervals around the periphery 4 of a disc 5. The blades 2 are of the platformless type. The inner boundary of the fluid flow path from upstream to downstream through the stage of blades is defined by the outer wall 6 of spacer blocks 7 disposed between the blades 2 and fixed to the disc 5, the spacer blocks also maintaining the desired spacing between adjacent blades 2.

Each spacer block 7 comprises a front wall 8 which extends radially inwards towards the axis of the rotor from the front end 9 of the outer wall 6 and which overlaps at least partially the front face 10 of the disc 5. In addition, the spacer block comprises a rear wall 11 which extends radially inwards towards the axis of the rotor from the rear end 12 of the outer wall 6 and which overlaps at least partially the rear face 13 of the disc 5.

The portions of the front 8 and rear 11 walls which overlap the front 10 and rear 13 faces of the disc 5 each possess at least one hook which extends axially towards the disc 5 and co-operates with a corresponding groove formed in the wall of the disc 5. The front wall 8 thus comprises at least one front hook 14 which extends rearwards and engages in a groove 15, and the rear wall 11 comprises at least one rear hook 16 which extends fowards and engages in a groove 17. The front and rear grooves 15 and 17 of the disc 5 extend between the two sockets 3 in which are mounted the two blades 2 adjacent the corresponding spacer block 7. The circumferential width of the hooks 14 and 16 must be less than the width of a socket 3 in the area of the grooves 15 and 17 in order to allow assembly of the stage of blades 1 as is explained later.

The rear wall 11 of the spacer block 7 is extended in the circumferential direction of the disc 5 by at least one flange 18 which closes off at least partially the rear end of a blade socket 3 adjacent the said spacer block 7. Preferably a flange 18 is provided at each side of the spacer block 7 as shown. In addition, the spacer block 7 possesses, on its front face, a locking lug 19 which extends towards the axis of the rotor and which is spaced away from the front face 10 of the disc 5, this locking lug 19 engaging with a supplementary groove 20 in the disc. An annular member 21 is placed between the front face 10 of the disc 5 and the locking lugs 19 of all the spacer blocks 7 so that the member 21 covers at least partially the front ends of the blade sockets 3. The annular member 21 and the flanges 18 of the spacer blocks 7 thus constitute the means by which the blades 2 are axially retained in the sockets 3.

In addition, each spacer block 7 includes, on the inner face of its outer wall 6, a median partition 22 which extends parallel to the adjacent blades 2 towards the periphery 4 of the disc 5. This median partition 22 contains a slot 23 adjacent the outer wall 6, and a leaf spring 24 fitted at each of its ends with damping pads 25 passes through the slot 23. The assembly consisting of the leaf spring 24 and the damping pads 25 constitutes a vibration damper. The leaf spring 24 has a curved shape, such that, when the rotor 1 stops, the damping pads lie adjacent the periphery 4 of the disc 5. In operation, however, the action of centrifugal force causes the damping pads 25 to move away from the periphery 4 of the disc 5, against the bending strength of the leaf spring 24. The damping pads 25 then come to bear against the adjacent blades 2 and thereby promote the damping of vibrations. Each spacer block 7 also includes additional walls 27 which extend inwards from the inner face of the outer wall 6 at right angles to the median partition 22 and which serve as limit stops for the damping pads 25.

The spacer block 7 is made of a composite material. The vibration damper 25 can be made by fitting the damping pads 25 to the leaf spring 24, but it may also be made in one-piece, in which case it will be fitted in position at the time of manufacturing the spacer block.

The fitting of a blade 2 and an adjacent spacer block 7 on the disc 5 is carried out in the following way:

The blade 2 is fitted into a socket 3 by sliding it in a direction parallel to the axis of the socket 3, and the spacer block 7 is then fitted by positioning its base in the socket 3 adjacent to the blade 2 already fitted and sliding the block 7 in the plane of the disc 5 so that the two hooks 14 and 16 enter the corresponding grooves 15 and 17 and the block 7 comes up against the blade 2 which has already been fitted. The annular member 21 is rotated in the circumferential direction between the front face 10 of the disc 5 and the locking lugs 19 after fitting each blade-spacer block pair, and this fitting operation is continued up to the final blade 2'.

Figure 6:
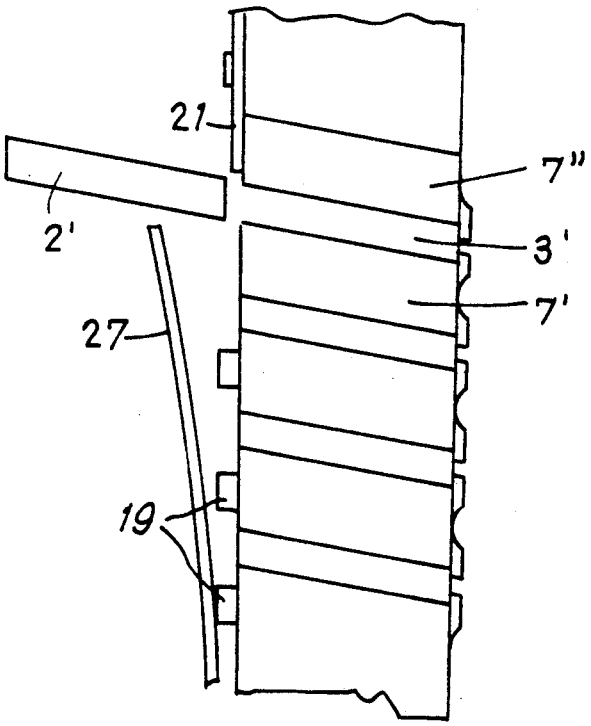
FIG. 6 is a schematic partial side view of the rotor, showing the fitting of the final blade.
Figure 7:
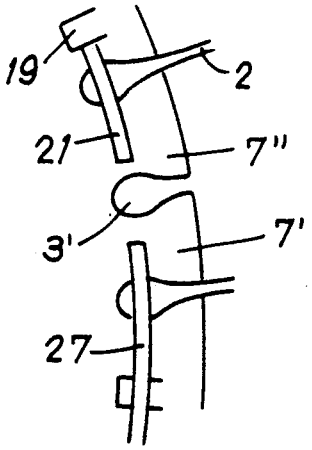
FIG. 7 is a schematic partial front view of the rotor before the fitting of the final blade.

To fit the final blade 2', one proceeds as shown in FIGS. 6 and 7. Firstly, one fits the two spacer blocks 7' and 7'' adjacent the socket 3' for the final blade, having previously taken care to pass the end 27 of the annular member 21 over the top of the corresponding locking lugs 19 in order to free the end of the axial socket 3', and then one slides the root of the blade 2' into the socket 3'. The adjacent flanges 18 of the two spacer blocks 7' and 7'' are obviously dimensioned so that it is possible to introduce the last spacer block 7'' into the socket 3' when the spacer block 7' is already correctly positioned. The annular member 21 is then rotated so that its end 27 is brought into position between the disc 5 and the locking lugs 19.

We claim:

1. A rotor for a fan or compressor stage of a turbo-shaft engine, said rotor having an axis of rotation and comprising:

a rotor disc having front and rear faces and a periphery, said periphery being formed with a plurality of sockets extending between said front and rear faces at intervals around said disc;

a plurality of blades mounted in said sockets and extending radially from said disc;

a plurality of spacer blocks disposed between said blades for maintaining the inter-blade spacing, said spacer blocks having axially opposite ends disposed substantially in the planes of said front and rear faces of said disc, and said spacer blocks each comprising an outer wall spaced outwardly from said periphery of said disc, and front and rear walls extending substantially radially inwards from said outer wall at said axially opposite ends of said spacer block so as to overlap at least partially said front and rear faces respectively of said disc, said outer wall having inner and outer faces, and said outer faces of said outer walls of said spacer blocks defining the inner boundary of the fluid flow path through said rotor;

means for fixing said spacer blocks to said disc; and means for axially retaining said blades in said sockets;

said means for fixing said spacer blocks to said disc comprising, for each of said spacer blocks, at least one front hook extending axially rearwards from said front wall of said spacer block, at least one rear hook extending axially forwards from said rear wall of said spacer block, and grooves provided in said front and rear faces of said disc for receiving said front and rear hooks respectively, said grooves extending between the two sockets in which the blades adjacent said spacer block are mounted, and said grooves and said hooks being arranged and dimensioned such that said spacer block can be fitted by inserting it in one of said two sockets and then sliding it in the plane of said disc to engage said hooks in said grooves.

2. A rotor in accordance with claim 1, wherein each of said spacer blocks possesses at least one flange which extends from said rear wall of said spacer block and overlaps at least partially one of said sockets adjacent said spacer block, and a locking lug which extends radially towards said rotor axis from said front wall of said spacer block, said locking lug being spaced from said front face of said disc, and said disc having an additional groove for receiving and co-operating with said locking lug, and wherein said means for axially retaining said blades in said sockets comprise an annular member interposed between said front face of said disc and said locking lugs of said spacer blocks on one side of the rotor, and said flanges of said spacer blocks on the other side of the rotor.

3. A rotor in accordance with claim 1, wherein each of said spacer blocks possesses a median partition which extends from said outer wall towards the periphery of said disc and is substantially parallel to the planes of said blades adjacent said spacer block, said partition being provided with a slot near said outer wall, and wherein said spacer block is fitted with a vibration damper, said damper comprising a leaf spring passing through said slot in said partition and damper pads provided at the ends of said leaf spring.

4. A rotor in accordance with claim 3, wherein each of said spacer blocks includes additional walls extending from said inner face of said outer wall on opposite sides of said partition, said additional walls serving as limit stops for said damping pads.

* * * * *